US009731401B2

(12) United States Patent
Maruyama et al.

(10) Patent No.: US 9,731,401 B2
(45) Date of Patent: Aug. 15, 2017

(54) METHOD AND APPARATUS FOR CONDITIONING POLISHING PAD

(71) Applicant: Ebara Corporation, Tokyo (JP)

(72) Inventors: Toru Maruyama, Tokyo (JP); Nobuyuki Takahashi, Tokyo (JP)

(73) Assignee: Ebara Corporation, Tokyo (JP)

( * ) Notice: Subject to any disclaimer, the term of this patent is extended or adjusted under 35 U.S.C. 154(b) by 60 days.

(21) Appl. No.: 14/624,820

(22) Filed: Feb. 18, 2015

(65) Prior Publication Data

US 2015/0231760 A1 Aug. 20, 2015

(30) Foreign Application Priority Data

Feb. 20, 2014 (JP) ..... 2014-030998

(51) Int. Cl.
*B24B 53/017* (2012.01)
*B24B 37/015* (2012.01)
(Continued)

(52) U.S. Cl.
CPC ..... *B24B 53/017* (2013.01); *B24B 37/015* (2013.01); *B24B 49/04* (2013.01); *B24B 49/14* (2013.01)

(58) Field of Classification Search
CPC ..... B24B 53/017; B24B 49/14; B24B 49/04; B24B 37/015
(Continued)

(56) References Cited

U.S. PATENT DOCUMENTS 5,708,506 A * 1/1998 Birang ..... B24B 49/12 356/600
5,749,772 A 5/1998 Shimokawa
(Continued)

FOREIGN PATENT DOCUMENTS

JP 09-234663 9/1997
JP 2003-151934 5/2003
(Continued)

OTHER PUBLICATIONS

Matsumura, et al., "Control of the polishing performance with polishing pad surface roughness,", *The Japan Society for Precision Engineering Spring Meeting Academic Conference Lecture Paper*, 949-950 (2004).
(Continued)

*Primary Examiner* — Robert Rose

(74) *Attorney, Agent, or Firm* — Leydig, Voit & Mayer, Ltd.

(57) ABSTRACT

A conditioning method which can efficiently produce surface roughness of a polishing pad to obtain an optimum polishing rate by performing dressing while monitoring the surface roughness of the polishing pad and adjusting a temperature of the polishing pad is disclosed. The conditioning method includes measuring surface roughness of the polishing pad during dressing of the polishing pad, comparing the measured surface roughness with preset target surface roughness to obtain comparison result, and adjusting a surface temperature of the polishing pad by heating or cooling the polishing pad based on the comparison result. The surface roughness is represented by at least one of five indexes comprising arithmetical mean deviation of the roughness profile (Ra), root mean square deviation of the roughness profile (Rq), maximum profile valley depth of the roughness profile (Rv), maximum profile peak height of the roughness profile (Rp), and maximum height of the roughness profile (Rz).

15 Claims, 7 Drawing Sheets

(51) Int. Cl.
*B24B 49/14* (2006.01)
*B24B 49/04* (2006.01)

(58) Field of Classification Search
USPC ..... 451/7, 53, 443, 444, 72, 56, 6, 287, 290
See application file for complete search history.

(56) References Cited

U.S. PATENT DOCUMENTS

| | | | | |
|---|---|---|---|---|
| 7,020,306 | B2 * | 3/2006 | Hirose | B24B 37/20 382/108 |
| 8,292,691 | B2 * | 10/2012 | Xu | B24B 37/015 451/5 |
| 2003/0100246 | A1 * | 5/2003 | Hirokawa | B24B 53/001 451/56 |
| 2005/0090185 | A1 | 4/2005 | Fujishima et al. | |

FOREIGN PATENT DOCUMENTS

| | | |
|---|---|---|
| JP | 2003-257914 | 9/2003 |
| JP | 2005-088128 | 4/2005 |
| JP | 2013-172218 | 9/2013 |

OTHER PUBLICATIONS

Akaji, et al., "The creation of break-in free pad and the result of CMP performance," *The Japan Society for Precision Engineering Spring Meeting Academic Conference Lecture Paper*, 1037-1038 (2009).

* cited by examiner

| | | | | | |
|---|---|---|---|---|---|
| | POLISHING RATE RR [nm/min] | 0.815927025 | 0.982491262 | 1.101786146 | 1.099795567 |
| NORMALIZED SURFACE ROUGHNESS Ra [μm] normalized | WHOLE REGION | 0.961770942 | 0.873798828 | 1.097236497 | 1.067193733 |
| | SELECTED REGION | 0.714357322 | 0.984174723 | 1.103329753 | 1.198138203 |
| SURFACE ROUGHNESS Ra [μm] | WHOLE REGION | 111.5133333 | 101.3133333 | 127.22 | 123.7366667 |
| | SELECTED REGION | 8.313333333 | 11.45333333 | 12.84 | 13.94333333 |

METHOD AND APPARATUS FOR CONDITIONING POLISHING PAD

CROSS REFERENCE TO RELATED APPLICATION

This document claims priority to Japanese Patent Application Number 2014-30998 filed Feb. 20, 2014, the entire contents of which are hereby incorporated by reference.

BACKGROUND

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). In the chemical mechanical polishing, using a polishing apparatus, while a polishing liquid containing abrasive particles such as ceria ($CeO_2$) therein is supplied onto a polishing pad, a substrate such as a semiconductor wafer is brought into sliding contact with the polishing pad, so that the substrate is polished.

The polishing apparatus for performing the above CMP process includes a polishing table having a polishing pad, and a substrate holding device, which is referred to as a top ring, a polishing head or the like, for holding a semiconductor wafer (substrate). By using such a polishing apparatus, the substrate is held and pressed against the polishing pad under a predetermined pressure by the substrate holding device to polish an insulating film, a metal film or the like on the substrate.

After one or more substrates have been polished, abrasive particles and polishing debris are attached to a surface of the polishing pad, the properties of the polishing pad are changed, and thus the polishing performance is deteriorated. Therefore, as the substrates are repeatedly polished, a polishing rate is lowered and non-uniform polishing is caused. Thus, dressing of the polishing pad is performed to regenerate the surface condition of the polishing pad which has deteriorated.

A dressing device for dressing the polishing pad includes an oscillatable arm and a dresser fixed to a distal end of the arm. In the dressing device, while the dresser is oscillated in a radial direction of the polishing pad by the arm and is rotated about the axis of the dresser, the dresser is pressed against the polishing pad on the rotating polishing table. Thus, the polishing liquid and the polishing debris which have been attached to the polishing pad are removed, and the polishing pad is planarized and dressed. The dresser having a surface (dressing surface), which is brought into contact with the pad surface, on which diamond abrasive particles are electrodeposited is used.

Conventionally, while a dressing liquid comprising pure water (DIW) having a predetermined temperature (e.g., approximately 20° C.) is supplied at a constant flow rate onto the polishing pad, dressing is performed for a predetermined time under the condition that the rotational speed, the dressing load, and the oscillating speed of the dresser are kept constant, respectively. During dressing, neither temperature control of the polishing pad nor monitoring of the surface roughness of the polishing pad is performed.

The surface of the polishing pad is roughened by dressing, and the surface roughness of the polishing pad has a correlation with a polishing rate. On the other hand, the surface roughness of the polishing pad is thought to be influenced by temperature of the polishing pad in addition to the conventional dressing conditions.

SUMMARY OF THE INVENTION

According to an embodiment, there is provided a conditioning method and a conditioning apparatus which can efficiently produce surface roughness of a polishing pad to obtain an optimum polishing rate by performing dressing while monitoring the surface roughness of the polishing pad and adjusting a temperature of the polishing pad.

Embodiments, which will be described below, relate to a conditioning method and a conditioning apparatus of a polishing pad which adjust the surface roughness of the polishing pad used for polishing a substrate such as a semiconductor wafer.

In an embodiment, there is provided a conditioning method for adjusting surface roughness of a polishing pad by dressing the polishing pad on a polishing table configured to polish a substrate with a dresser pressed against the polishing pad, comprising: measuring surface roughness of the polishing pad during dressing of the polishing pad, the surface roughness being represented by at least one of five indexes comprising arithmetical mean deviation of the roughness profile (Ra), root mean square deviation of the roughness profile (Rq), maximum profile valley depth of the roughness profile (Rv), maximum profile peak height of the roughness profile (Rp), and maximum height of the roughness profile (Rz); comparing the measured surface roughness with preset target surface roughness to obtain comparison result; and adjusting a surface temperature of the polishing pad by heating or cooling the polishing pad based on the comparison result.

According to the above embodiment, dressing of the polishing pad is performed while monitoring the surface roughness of the polishing pad during dressing of the polishing pad and adjusting the surface temperature of the polishing pad based on the monitored surface roughness. By monitoring the surface roughness, if the measured surface roughness is larger than the target surface roughness, the surface temperature of the polishing pad is raised to thereby increase the elastic modulus of the polishing pad, whereby the surface roughness of the polishing pad formed by the dresser is controlled to be finer. Conversely, if the measured surface roughness is smaller than the target surface roughness, the surface temperature of the polishing pad is decreased to thereby lower the elastic modulus of the polishing pad, whereby the surface roughness of the polishing pad formed by the dresser is controlled to be rougher.

In an embodiment, the dressing of the polishing pad is performed while adjusting the surface temperature of the polishing pad to a predetermined temperature until the measured surface roughness reaches the target surface roughness.

According to the above embodiment, the dressing of the polishing pad is performed while adjusting the surface temperature of the polishing pad, and the surface roughness is judged by comparing the measured surface roughness of the polishing pad and the preset target surface roughness. When the measured surface roughness is equal to the target surface roughness, dressing of the polishing pad is finished and adjustment of the surface temperature of the polishing pad is finished. When the measured surface roughness is not equal to the target surface roughness, the surface temperature of the polishing pad is controlled continuously, while performing dressing, so that the measured surface roughness becomes the target surface roughness.

In an embodiment, the predetermined temperature is a surface temperature of the polishing pad corresponding to desired polishing performance based on relationship between surface roughness of the polishing pad and surface temperature of the polishing pad, and relationship between surface roughness of the polishing pad and polishing performance.

According to the above embodiment, by using the relationship between the surface roughness of the polishing pad and the surface temperature of the polishing pad and the relationship between the surface roughness of the polishing pad and the polishing performance, the surface temperature of the polishing pad to be adjusted to obtain the desired polishing performance (polishing rate) through the surface roughness of the polishing pad can be set.

In an embodiment, the dressing is finished when the surface roughness of the polishing pad reaches the target surface roughness.

In an embodiment, the dressing is started when the surface temperature of the polishing pad reaches a predetermined temperature.

In an embodiment, when the surface roughness of the polishing pad is measured, the dresser is pressed against the polishing pad and oscillated and the polishing table is rotated, or the dresser is spaced from the polishing pad and rotation of the polishing table is stopped.

In an embodiment, the adjustment of the surface temperature of the polishing pad is performed by bringing a pad contact member, into which a temperature-adjusted fluid is supplied, into contact with the polishing pad, or by supplying a temperature-adjusted fluid to the polishing pad.

In an embodiment, the dressing is performed during polishing a substrate while adjusting the surface temperature of the polishing pad.

In an embodiment, there is provided a conditioning method for adjusting surface roughness of a polishing pad by dressing the polishing pad on a polishing table configured to polish a substrate with a dresser pressed against the polishing pad, comprising: adjusting a surface temperature of the polishing pad to a predetermined temperature during dressing of the polishing pad.

According to the above embodiment, the surface roughness of the polishing pad to obtain the optimum polishing rate can be produced efficiently by adjusting the surface temperature of the polishing pad during dressing of the polishing pad.

In an embodiment, the conditioning method further comprises monitoring surface roughness of the polishing pad during the dressing of the polishing pad, the surface roughness being represented by at least one of five indexes comprising arithmetical mean deviation of the roughness profile (Ra), root mean square deviation of the roughness profile (Rq); maximum profile valley depth of the roughness profile (Rv), maximum profile peak height of the roughness profile (Rp), and maximum height of the roughness profile (Rz).

In an embodiment, the predetermined temperature is a surface temperature of the polishing pad corresponding to desired polishing performance based on relationship between surface roughness of the polishing pad and surface temperature of the polishing pad, and relationship between surface roughness of the polishing pad and polishing performance.

In an embodiment, the adjustment of the surface temperature of the polishing pad is performed by bringing a pad contact member, into which a temperature-adjusted fluid is supplied, into contact with the polishing pad, or by supplying a temperature-adjusted fluid to the polishing pad.

In an embodiment, the dressing is finished when the surface roughness of the polishing pad reaches desired surface roughness.

In an embodiment, the surface temperature of the polishing pad is adjusted so as to be maintained at the predetermined temperature until surface roughness of the polishing pad reaches the desired surface roughness.

In an embodiment, the dressing is performed by defining a plurality of areas in a radial direction of the polishing pad and adjusting the respective areas to different temperatures.

In an embodiment, the dressing is performed during polishing a substrate while adjusting the surface temperature of the polishing pad.

In an embodiment, there is provided a conditioning apparatus for adjusting surface roughness of a polishing pad by dressing the polishing pad on a polishing table configured to polish a substrate, comprising: a dressing device comprising a dresser configured to dress the polishing pad by being pressed against the polishing pad, and a mechanism configured to rotate the dresser and move the dresser along a surface of the polishing pad; a surface roughness measuring device of the polishing pad configured to measure surface roughness of the polishing pad; a temperature adjustment device of the polishing pad configured to adjust a surface temperature of the polishing pad; and a control unit configured to control the dressing device, the surface roughness measuring device, and the temperature adjustment device; wherein the surface roughness of the polishing pad represented by at least one of five indexes comprising arithmetical mean deviation of the roughness profile (Ra), root mean square deviation of the roughness profile (Rq), maximum profile valley depth of the roughness profile (Rv), maximum profile peak height of the roughness profile (Rp), and maximum height of the roughness profile (Rz) is measured by the surface roughness measuring device of the polishing pad during dressing of the polishing pad.

In an embodiment, the control unit adjusts the surface temperature of the polishing pad by comparing the surface roughness measured by the surface roughness measuring device with preset target surface roughness to obtain comparison result, and by controlling the temperature adjustment device of the polishing pad based on the comparison result.

In an embodiment, relationship between surface roughness of the polishing pad and surface temperature of the polishing pad, and relationship between surface roughness of the polishing pad and polishing performance are stored in the control unit.

In an embodiment, the temperature adjustment device of the polishing pad comprises a pad contact member, into which a temperature-adjusted fluid is supplied, whose lower surface is brought into contact with the polishing pad, or comprises a nozzle configured to supply a temperature-adjusted fluid to the polishing pad.

In an embodiment, two or more of the pad contact members or the nozzles are provided in a radial direction of the polishing pad; and the two or more of the pad contact members or the nozzles are capable of adjusting the surface temperature of the polishing pad independently.

According to the above embodiment, the temperature of the polishing pad can be adjusted at respective radially different areas of the polishing pad by the two or more of the pad contact members or the nozzles during dressing, and thus the surface roughness can be varied in a radial direction of the polishing pad. In this manner, by forming areas having different surface roughnesses in the radial direction of the polishing pad, the polishing profile of the substrate can be adjusted.

In an embodiment, the surface roughness measuring device of the polishing pad is attached to a dresser arm configured to hold the dresser.

In an embodiment, the surface roughness measuring device of the polishing pad is arranged at a position where the surface roughness is measured at a downstream side of the dresser with respect to a rotational direction of the polishing table.

According to the above embodiment, since the surface roughness measuring device of the polishing pad is arranged at a position where the surface roughness is measured at a downstream side of the dresser with respect to a rotational direction of the polishing table, the surface roughness measuring device of the polishing pad can measure the surface roughness of the polishing pad immediately after dressing at the location where the polishing pad has been dressed by the dresser.

In an embodiment, the surface roughness measuring device of the polishing pad comprises a light emitting unit configured to emit a laser light and a light receiving unit configured to receive a light reflected by the polishing pad.

In an embodiment, there is provided a polishing apparatus comprising: a polishing table to which a polishing pad is attached; and a conditioning apparatus of the polishing pad according to claim 14.

The above-described embodiments achieve the following advantageous effects:

1) By dressing the polishing pad while monitoring the surface roughness of the polishing pad and adjusting the temperature of the polishing pad, the surface roughness of the polishing pad to obtain the optimum polishing rate can be produced efficiently.

2) By obtaining the targeted surface roughness of the polishing pad, the polishing rate is optimized to thus improve productivity and improve a product yield.

3) By roughening the surface of the polishing pad efficiently, a lifetime of the polishing pad can be prolonged.

BRIEF DESCRIPTION OF THE DRAWINGS

FIG. 3A is an enlarged view of part A of FIG. 2A, and FIG. 3B is an enlarged view showing the diamond abrasive particle shown in FIG. 3A and its adjacent diamond abrasive particles;

DETAILED DESCRIPTION OF EMBODIMENTS

Figure 1:
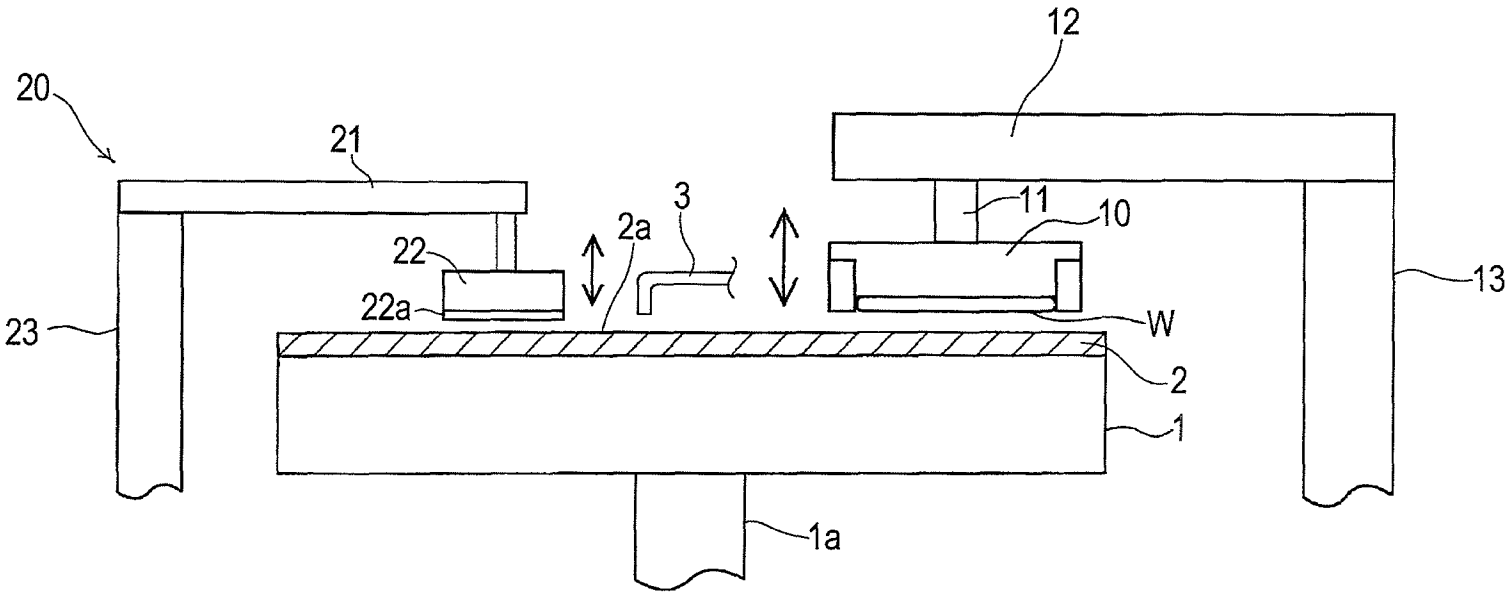
FIG. 1 is a schematic view showing an entire structure of a polishing apparatus incorporating a conditioning apparatus of a polishing pad according to an embodiment.

Embodiments of a method and apparatus for conditioning a polishing pad will be described below with reference to FIGS. 1 through 8. Like or corresponding parts are denoted by corresponding reference numerals in FIGS. 1 through 8 and will not be described below repetitively.

FIG. 1 is a schematic view showing an entire structure of a polishing apparatus incorporating a conditioning apparatus of a polishing pad according to an embodiment. As shown in FIG. 1, the polishing apparatus includes a polishing table 1, and a top ring 10 for holding a substrate W such as a semiconductor wafer as an object to be polished and pressing the substrate W against a polishing pad on the polishing table. The polishing table 1 is coupled via a table shaft 1*a* to a polishing table rotating motor (not shown) disposed below the polishing table 1. Thus, the polishing table 1 is rotatable about the table shaft 1*a*. A polishing pad 2 is attached to an upper surface of the polishing table 1. A surface of the polishing pad 2 constitutes a polishing surface 2*a* for polishing the substrate W. The polishing pad 2 comprising SUBA800, IC1000, IC1000/SUBA400 (two-layered cloth) manufactured by the Dow Chemical Company, or the like is used. SUBA800 is a non-woven fabric made of fibers fixed with urethane resin. IC1000 is a pad made of hard perforated polyurethane and having a large number of fine holes (pores) formed in its surface, and is also called a perforated pad. A supply nozzle 3 is provided above the polishing table 1 to supply a polishing liquid (slurry) onto the polishing pad 2 on the polishing table 1.

The top ring 10 is connected to a top ring shaft 11, and the top ring shaft 11 is vertically movable with respect to a top ring head 12. When the top ring shaft 11 moves vertically, the top ring 10 is lifted and lowered as a whole to be positioned with respect to the top ring head 12. The top ring shaft 11 is rotated by driving a top ring rotating motor (not shown). The top ring 10 is rotated about the top ring shaft 11 by the rotation of the top ring shaft 11.

The top ring 10 is configured to hold the substrate W such as a semiconductor wafer on its lower surface. The top ring head 12 is configured to be pivotable about a top ring head shaft 13. Thus, the top ring 10, which holds the substrate W on its lower surface, is movable from a substrate receiving position to a position above the polishing table 1 by the pivot movement of the top ring head 12. The top ring 10 holds the substrate W on its lower surface and presses the substrate W against the surface (polishing surface) of the polishing pad 2. At this time, while the polishing table 1 and the top ring 10 are respectively rotated, the polishing liquid is supplied onto the polishing pad 2 from the polishing liquid supply nozzle 3 provided above the polishing table 1. The polishing liquid containing silica ($SiO_2$), ceria ($CeO_2$) or the like as abrasive particles is used. In this manner, while the polishing liquid is supplied onto the polishing pad 2, the substrate W is pressed against the polishing pad 2, and the substrate W and the polishing pad 2 are moved relative to each other to thereby polish an insulating film, a metal film or the like on the substrate. Examples of the insulating film include $SiO_2$, and examples of the metal film include a Cu film, a W film, a Ta film and a Ti film.

As shown in FIG. 1, the polishing apparatus has a dressing device 20 for dressing the polishing pad 2. The dressing device 20 includes a dresser arm 21, a dresser 22 rotatably attached to a distal end of the dresser arm 21, and an oscillation shaft 23 coupled to the other end of the dresser arm 21. The lower part of the dresser 22 comprises a dressing member 22*a*, which has a circular dressing surface. Hard abrasive particles are fixed to the dressing surface by electrodeposition or the like. Examples of the hard abrasive particles include diamond abrasive particles, ceramic abrasive particles and the like. The dresser 22 is rotated by a motor (not shown). The oscillation shaft 23 is rotated by a motor (not shown) to oscillate the dresser arm 21 about the oscillation shaft 23, thereby oscillating the dresser 22.

The present inventors have conducted dressing of the polishing pad 2 by using the dresser 22 shown in FIG. 1 and obtained the following knowledge.

The polishing pad has an elastic modulus which varies according to temperature. Specifically, when the temperature is high, the elastic modulus of the polishing pad is high, and when the temperature is low, the elastic modulus of the polishing pad is low. The elastic modulus of the polishing pad affects the surface roughness of the polishing pad when the polishing pad is dressed.

1) In the Case where the Elastic Modulus of the Polishing Pad is Low

Figure 2A:
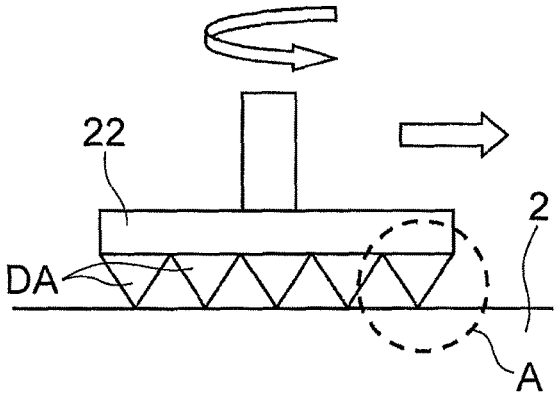
FIG. 2A is a schematic view showing a state in which the polishing pad is dressed by a dresser having diamond abrasive particles on its lower surface.
Figure 2B:
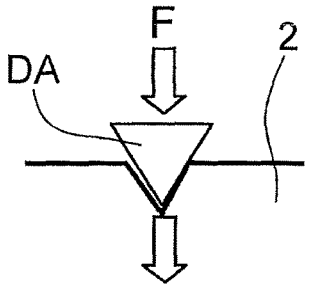
FIG. 2B is an enlarged view of part A of FIG. 2A.

FIG. 2A is a schematic view showing a state in which the polishing pad 2 is dressed by the dresser 22 having diamond abrasive particles DA on its lower surface, and FIG. 2B is an enlarged view of part A of FIG. 2A. In FIGS. 2A and 2B, the diamond abrasive particles DA are shown enlarged. As shown by arrows in FIG. 2A, during dressing, the dresser 22 is moved along the surface of the polishing pad 2 while being rotated about the axis of the dresser 22. As shown in FIG. 2B, at the time of dressing, the diamond abrasive particles DA cut into the surface of the polishing pad 2 by a dresser load. At this time, in the case where the elastic modulus of the polishing pad is low, the polishing pad is hard, and thus a force with which the diamond abrasive particles DA of the dresser 22 press the polishing pad 2 is not dispersed. Therefore, the polishing pad 2 thoroughly receives the force with which the diamond abrasive particles DA press the polishing pad 2. In FIG. 2B, the force with which the diamond abrasive particle DA presses the polishing pad 2 is shown by a solid line arrow F, and the polishing pad 2 thoroughly receives the force F as shown by a solid line arrow. Thus, when a load is applied to the abrasive particles, the abrasive particles scrape off the polishing pad 2 by an amount corresponding to the applied load, and the surface roughness of the polishing pad 2 is more likely to become rough.

2) In the Case where the Elastic Modulus of the Polishing Pad is High

Figure 3A:
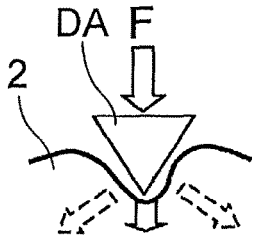
FIGS. 3A and 3B are views showing the relationship between the polishing pad and the diamond abrasive particles in the case where the elastic modulus of the polishing pad is high.
Figure 3B:
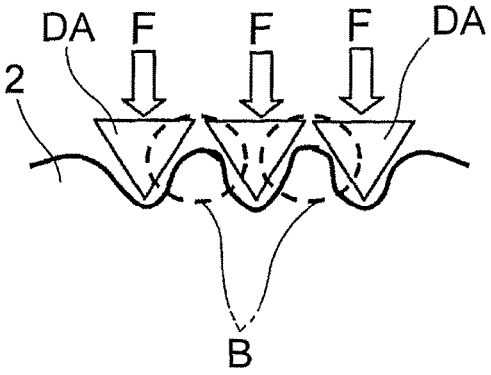

FIGS. 3A and 3B are views showing the relationship between the polishing pad and the diamond abrasive particles DA in the case where the elastic modulus of the polishing pad is high. FIG. 3A is an enlarged view of part A of FIG. 2A, and FIG. 3B is an enlarged view showing the diamond abrasive particle DA shown in FIG. 3A and its adjacent diamond abrasive particles DA.

In the case where the elastic modulus of the polishing pad is high, the polishing pad is soft, and thus a force with which the diamond abrasive particle DA presses the polishing pad 2 is dispersed in lateral directions as shown in FIG. 3A. Therefore, the polishing pad 2 does not sufficiently receive the force with which the diamond abrasive particle DA presses the polishing pad 2. In FIG. 3A, the force with which the diamond abrasive particle DA presses the polishing pad 2 is shown by a solid line arrow F, and the polishing pad 2 receives the force F as shown by a solid arrow while part of the force is dispersed as shown by dashed line arrows. Therefore, the abrasive particles are less likely to scrape off the polishing pad 2, and the surface roughness of the polishing pad 2 is more likely to become fine. Further, as shown in part B of FIG. 3B, bumps of the polishing pad 2 between adjacent abrasive particles affect the manner in which the polishing pad 2 is scraped off. From this point also, the surface roughness of the polishing pad 2 is more likely to become fine.

As can be seen from the above 1) and 2), the manner in which the polishing pad is scraped off when the polishing pad is dressed differs according to the elastic modulus of the polishing pad, with the result that the surface roughness of the polishing pad differs. Further, as described above, the elastic modulus of the polishing pad differs with the temperature. Specifically, when the temperature is high, the elastic modulus of the polishing pad is high, and when the temperature is low, the elastic modulus of the polishing pad is low. Thus, it is understood that there is a correlation between the temperature of the polishing pad at the time of dressing and the surface roughness of the dressed polishing pad.

Figure 4:
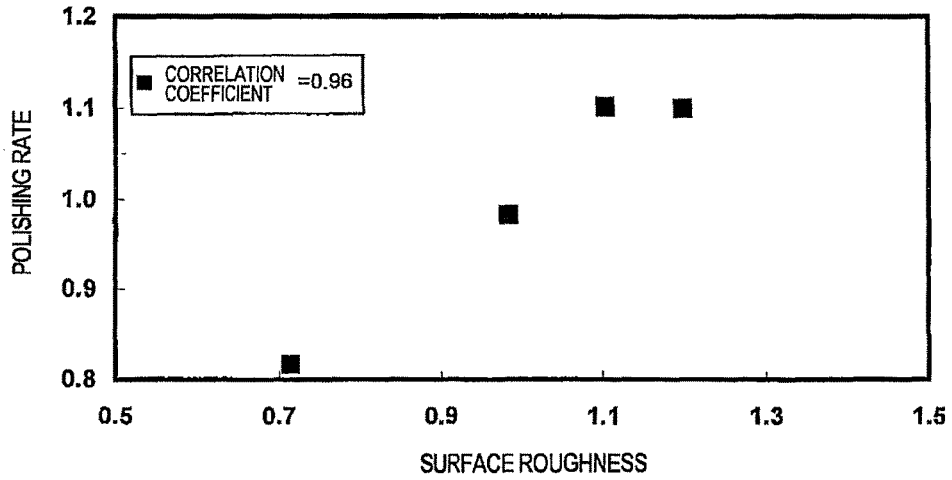
FIG. 4 is a table and a graph of measured data showing the relationship between the surface roughness of the polishing pad and the polishing rate.

Next, the relationship between the surface roughness of the polishing pad and the polishing performance (polishing rate) is shown in FIG. 4.

FIG. 4 is a table and a graph of measured data showing the relationship between the arithmetical mean deviation of the roughness profile (Ra) and the polishing rate (RR). The unit of the polishing rate is nm/min. The data shown in the graph of FIG. 4 are data in the case where a region of the polishing pad showing a strong correlation such that a correlation coefficient between the surface roughness and the polishing rate becomes 0.96 is selected to determine the surface roughness. The data shown in the table of FIG. 4 are the surface roughnesses of the polishing pad surface and the normalized surface roughnesses when polishing is performed at four different polishing rates. As is clear from FIG. 4, as the surface roughness of the polishing pad increases, the polishing rate increases, and takes the maximum value in the vicinity of the surface roughness of 1.1. In this manner, it is understood that the surface roughness of the polishing pad shows a strong connection with the polishing performance.

As described above, since the surface roughness of the polishing pad has the correlation with the surface temperature and the polishing performance of the polishing pad, the surface temperature of the polishing pad, at the time of dressing, which corresponds to the desired polishing performance can be determined from the relationship between the surface roughness of the polishing pad and the surface temperature of the polishing pad and the relationship between the surface roughness of the polishing pad and the polishing performance.

Specifically, in the case where there is a target of polishing performance to be achieved, the surface roughness (target) of the polishing pad corresponding to the targeted polishing performance is determined. Then, while performing temperature control so that the surface temperature of the polishing pad becomes a temperature corresponding to the determined surface roughness, the polishing pad is dressed under the dressing condition in accordance with the pad temperature and the pad surface roughness. During dressing, the surface roughness of the polishing pad is monitored, and when the surface roughness of the polishing pad reaches the target surface roughness, the dressing is finished. If the surface roughness of the polishing pad does not reach the target surface roughness after a predetermined time has elapsed, the target surface roughness and the monitored surface roughness (or measured surface roughness) are compared and the polishing pad temperature is adjusted so as to increase or decrease based on the difference between the target surface roughness and the monitored surface roughness.

On the basis of the above knowledge, according to an embodiment of the present invention, dressing of the polishing pad 2 is performed while monitoring the surface roughness of the polishing pad 2 during dressing of the polishing pad 2 and adjusting the surface temperature of the polishing pad 2 based on the monitored surface roughness.

Therefore, a conditioning apparatus according to an embodiment includes a measuring unit for measuring the surface roughness of the polishing pad and a temperature adjustment unit for adjusting the temperature of the polishing pad, in addition to the dressing device 20.

Figure 5:
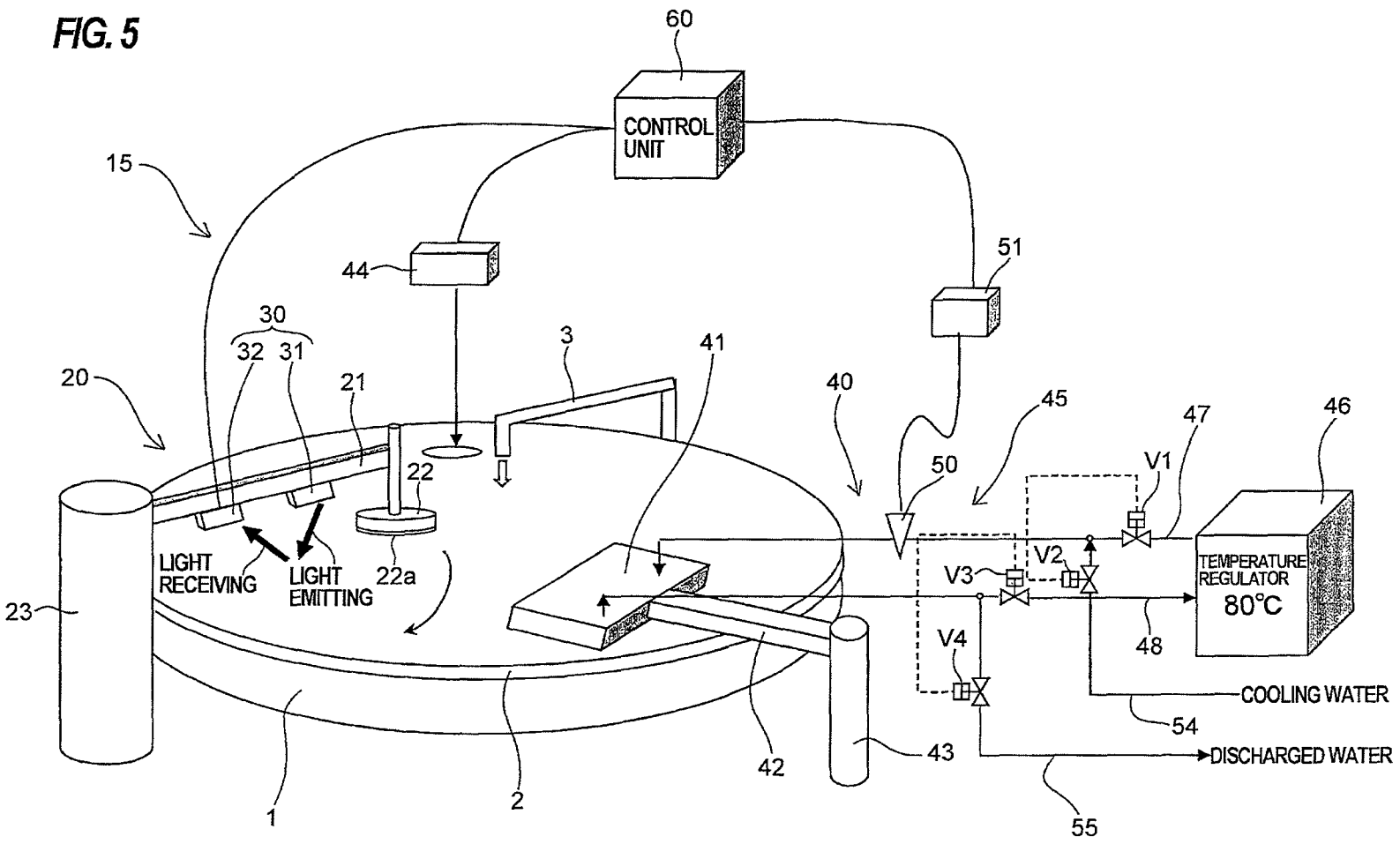
FIG. 5 is a schematic view showing a conditioning apparatus.

FIG. 5 is a schematic view showing a conditioning apparatus 15 according to an embodiment. As shown in FIG. 5, the conditioning apparatus 15 includes a measuring unit 30 for measuring the surface roughness of the polishing pad and a temperature adjustment unit 40 for adjusting the temperature of the polishing pad, in addition to the dressing device 20.

As shown in FIG. 5, the measuring unit 30 for measuring the surface roughness of the polishing pad (surface roughness measuring means) includes a light emitting unit 31 for emitting a laser light to the polishing pad 2, and a light receiving unit 32 for receiving the light that is reflected and scattered by the surface of the polishing pad 2 after the laser light has been emitted from the light emitting unit 31. The light receiving unit 32 comprises a CCD sensor, a CMOS sensor or the like. In this embodiment, the light emitting unit 31 and the light receiving unit 32 are supported by the dresser arm 21 of the dressing device 20. As the dresser arm 21 is oscillated, the light emitting unit 31 and the light receiving unit 32 are moved above the polishing pad 2 to emit the light to a large number of locations on the polishing pad 2 and to receive the reflected and scattered light at the large number of locations. The light receiving unit 32 is connected to a control unit 60. The control unit 60 is configured to image and process the light received by the light receiving unit 32 and to calculate the surface roughness of the polishing pad 2. The indexes of the surface roughness determined by the control unit 60 include the arithmetical mean deviation of the roughness profile (Ra), the root mean square deviation of the roughness profile (Rq), the maximum profile valley depth of the roughness profile (Rv), the maximum profile peak height of the roughness profile (Rp), and the maximum height of the roughness profile (Rz). These indexes of the pad surface roughness are indexes showing a strong connection with the polishing performance (polishing rate). The measuring unit 30 for measuring the surface roughness of the polishing pad and the control unit 60 are configured to measure the surface roughness represented by the above indexes and to monitor the measured values. The measuring unit 30 for measuring the surface roughness of the polishing pad is preferably arranged at a position where the surface roughness is measured at a downstream side of the dresser 22 with respect to a rotational direction of the polishing table 1. With this arrangement, the measuring unit 30 for measuring the surface roughness of the polishing pad can measure the surface roughness of the polishing pad 2 immediately after dressing at the location where the polishing pad 2 has been dressed by the dresser 22.

As shown in FIG. 5, the temperature adjustment unit 40 for adjusting the temperature of the polishing pad (temperature adjustment means) includes a pad contact member 41 that is brought into contact with the surface of the polishing pad 2, a thermograph or radiation thermometer 44 for measuring the surface temperature of the polishing pad 2 in a non-contact manner, and a liquid supply system 45 for supplying a temperature-controlled liquid to the pad contact member 41. The pad contact member 41 has a flow passage for allowing a liquid serving as a heating medium to flow therethrough, and is configured to heat or cool the polishing pad 2 by bringing the lower surface of the pad contact member 41 into contact with the surface of the polishing pad 2. The pad contact member 41 is supported by a support shaft 43 via a support arm 42. The pad contact member 41 is configured to be vertically movable between a contact position where the pad contact member 41 is brought into contact with the polishing pad 2 and an elevated position located above the contact position and to be movable in a radial direction of the polishing table 1.

The liquid supply system 45 has a liquid supply tank 46, and a supply line 47 and a return line 48 for coupling the liquid supply tank 46 and the pad contact member 41. The liquid, as the heating medium, is supplied to the pad contact member 41 from the liquid supply tank 46 through the supply line 47, and is returned from the pad contact member 41 to the liquid supply tank 46 through the return line 48. In this manner, the liquid circulates between the liquid supply tank 46 and the pad contact member 41. The liquid supply tank 46 has a heater (not shown) for heating the liquid, and thus the liquid is heated to a predetermined temperature by the heater. Specifically, the liquid supply tank 46 serves as a temperature regulator.

The liquid supply system 45 further includes a flow rate regulating valve 50 for regulating a flow rate of the liquid flowing through the supplying line 47, and a temperature controller 51 for controlling the flow rate regulating valve 50. A cooling water line 54 is connected to the supply line 47, and thus cooling water can be supplied to the supply line 47 from the cooling water line 54. Cooling water is supplied to the cooling water line 54 from factory utilities or a chiller. Further, a discharge line 55 is connected to the return line 48, and thus the liquid flowing through the return line 48 can be discharged therefrom.

The thermograph or radiation thermometer 44 is designed to measure the surface temperature of the polishing pad 2 and send the measured value to the control unit 60. The control unit 60 compares the surface roughness of the polishing pad 2 measured by the measuring unit 30 (measured surface roughness) with the preset target surface roughness of the polishing pad (target surface roughness), and arithmetically calculates the surface temperature, of the polishing pad 2, to be controlled (control target temperature) from the roughness comparison result and from the surface temperature of the polishing pad 2 measured by the thermograph or radiation thermometer 44 (measured surface temperature). The control unit 60 sends the calculated control target temperature of the polishing pad 2 to the temperature controller 51. The temperature controller 51 controls the flow rate regulating valve 50 based on the control target temperature of the polishing pad 2, thereby controlling the flow rate of the liquid supplied to the pad contact member 41. The surface temperature of the polishing pad 2 is adjusted by the heat exchange between the liquid flowing through the pad contact member 41 and the polishing pad 2.

The surface temperature of the polishing pad 2 is controlled by regulating the flow rate of the temperature-controlled liquid to be supplied to the pad contact member 41. Water is used as the liquid (heating medium) to be supplied to the pad contact member 41. The water is heated by the heater of the liquid supply tank 46 to, for example, about 80° C., thus becoming heated water. In order to enable heated water and cooling water to be supplied interchangeably by switching to the pad contact member 41, the supply line 47, the return line 48, the cooling water line 54, and the discharge line 55 are provided with valves V1 to V4 respectively. Specifically, a valve V1 is installed in the supply line 47, so that heated water can be supplied to the pad contact member 41 via the valve V1. A valve V2 is installed in the cooling water line 54, so that cooling water can be supplied to the pad contact member 41 via the valve V2. A valve V3 is installed in the return line 48, so that heated water which has been supplied to the pad contact member 41 can be returned to the liquid supply tank 46 via the valve V3. Cooling water flowing through the return line 48 can be discharged via the valve V4. When heated water is supplied to the pad contact member 41, the valves V1 and V3 are operated to be "Open", and the valves V2 and V4 are operated to be "Close". When cooling water is supplied to the pad contact member 41, the valves V1 and V3 are operated to be "Close", and the valves V2 and V4 are operated to be "Open".

Next, the operation of the conditioning apparatus 15 configured as shown in FIG. 5 will be described.

The targeted surface roughness of the polishing pad determined from the CMP process (target surface roughness) has been preset in the control unit 60. Further, dressing has been performed under the dressing conditions that the dresser load, the dresser rotational speed, the dressing time, and the rotational speed of the polishing table are kept constant respectively while the temperature of the polishing pad is changed, and the surface roughness of the polishing pad at each temperature has been measured. In this manner, the relationship between the surface roughness of the polishing pad and the temperature of the polishing pad has been obtained in advance and stored in the control unit 60. The dressing condition in which an oscillating speed of the dresser is kept constant may be added. The above relationship has been stored in a format of a table or the like.

The conditioning apparatus 15 starts operations when dressing of the polishing pad 2 is needed, as in the case after polishing a single substrate or a predetermined number of substrates, and performs the following operations. The dresser 22 starts dressing of the polishing pad 2, and the temperature adjustment unit 40 starts adjustment of the surface temperature of the polishing pad 2. During the dressing process, a dressing liquid, for example, pure water (DIW) is supplied onto the polishing pad 2 from the supply nozzle 3. Further, during the dressing process of the polishing pad 2 by the dresser 22, the laser light is emitted onto the polishing pad 2 from the light emitting unit 31 of the measuring unit 30 for measuring the surface roughness of the polishing pad, and the light that has been reflected and scattered by the polishing pad 2 is received by the light receiving unit 32. Then, the light received by the light receiving unit 32 is imaged and processed by the control unit 60 to calculate the surface roughness of the polishing pad 2. The indexes of the pad surface roughness determined by the control unit 60 are indexes showing correlation with the polishing performance (polishing rate), and include the arithmetical mean deviation of the roughness profile (Ra), the root mean square deviation of the roughness profile (Rq), the maximum profile valley depth of the roughness profile (Rv), the maximum profile peak height of the roughness profile (Rp), and the maximum height of the roughness profile (Rz). The control unit 60 obtains at least one of these five indexes.

During the dressing process, the surface temperature of the polishing pad 2 (measured surface temperature) is inputted into the control unit 60 from the thermograph or radiation thermometer 44. The control unit 60 compares the surface roughness of the polishing pad 2 measured by the measuring unit 30 (measured surface roughness) with the preset target surface roughness of the polishing pad (target surface roughness), and arithmetically calculates the surface temperature, of the polishing pad 2, to be controlled (control target temperature) from the roughness comparison result and from the surface temperature of the polishing pad 2 measured by the thermograph or radiation thermometer 44 (measured surface temperature). The control unit 60 sends the calculated control target temperature of the polishing pad 2 to the temperature controller 51. The temperature controller 51 controls the flow rate regulating valve 50 based on the control target temperature of the polishing pad 2, thereby controlling the surface temperature of the polishing pad.

More specifically, the control unit 60 compares the measured surface roughness with the target surface roughness, and if the measured surface roughness is larger than the target surface roughness, a control target temperature higher than the measured surface temperature of the polishing pad 2 is sent to the temperature controller 51. Conversely, if the measured surface roughness is smaller than the target surface roughness, a control target temperature lower than the measured surface temperature of the polishing pad 2 is sent to the temperature controller 51. The temperature controller 51 controls the flow rate regulating valve 50 based on the control target temperature of the polishing pad 2, thereby controlling the surface temperature of the polishing pad. The surface temperature of the polishing pad 2 can be controlled to a desired value by controlling the flow rate of heated water or cooling water to be supplied to the pad contact member 41 with the flow rate regulating valve 50.

In this manner, dressing of the polishing pad 2 is performed while monitoring the surface roughness of the polishing pad 2 during dressing of the polishing pad 2 and adjusting the surface temperature of the polishing pad 2 based on the monitored surface roughness. By monitoring the surface roughness, if the measured surface roughness is larger than the target surface roughness, the surface temperature of the polishing pad 2 is raised so as to be higher than the measured surface temperature to thereby increase the elastic modulus of the polishing pad 2, whereby the surface roughness of the polishing pad 2 formed by the dresser 22 is controlled to be finer. Conversely, if the measured surface roughness is smaller than the target surface roughness, the surface temperature of the polishing pad 2 is decreased so as to be lower than the measured surface temperature to thereby lower the elastic modulus of the polishing pad 2, whereby the surface roughness of the polishing pad 2 formed by the dresser 22 is controlled to be rougher.

In FIG. 5, as the temperature adjustment unit 40 of the polishing pad, a unit which controls the surface temperature of the polishing pad 2 by supplying heated water or cooling water to the pad contact member 41 and bringing the lower surface of the pad contact member 41 into contact with the surface of the polishing pad 2 is shown. However, a temperature adjustment unit of the polishing pad (temperature adjustment means) having at least one nozzle for spraying a temperature-controlled fluid onto the surface of the polishing pad 2 may be used. Further, a temperature adjustment unit of the polishing pad (temperature adjustment means) which controls a dressing liquid (e.g., pure water) supplied onto the polishing pad 2 from the supply nozzle 3 during dressing to a predetermined temperature may be used.

Figure 6:
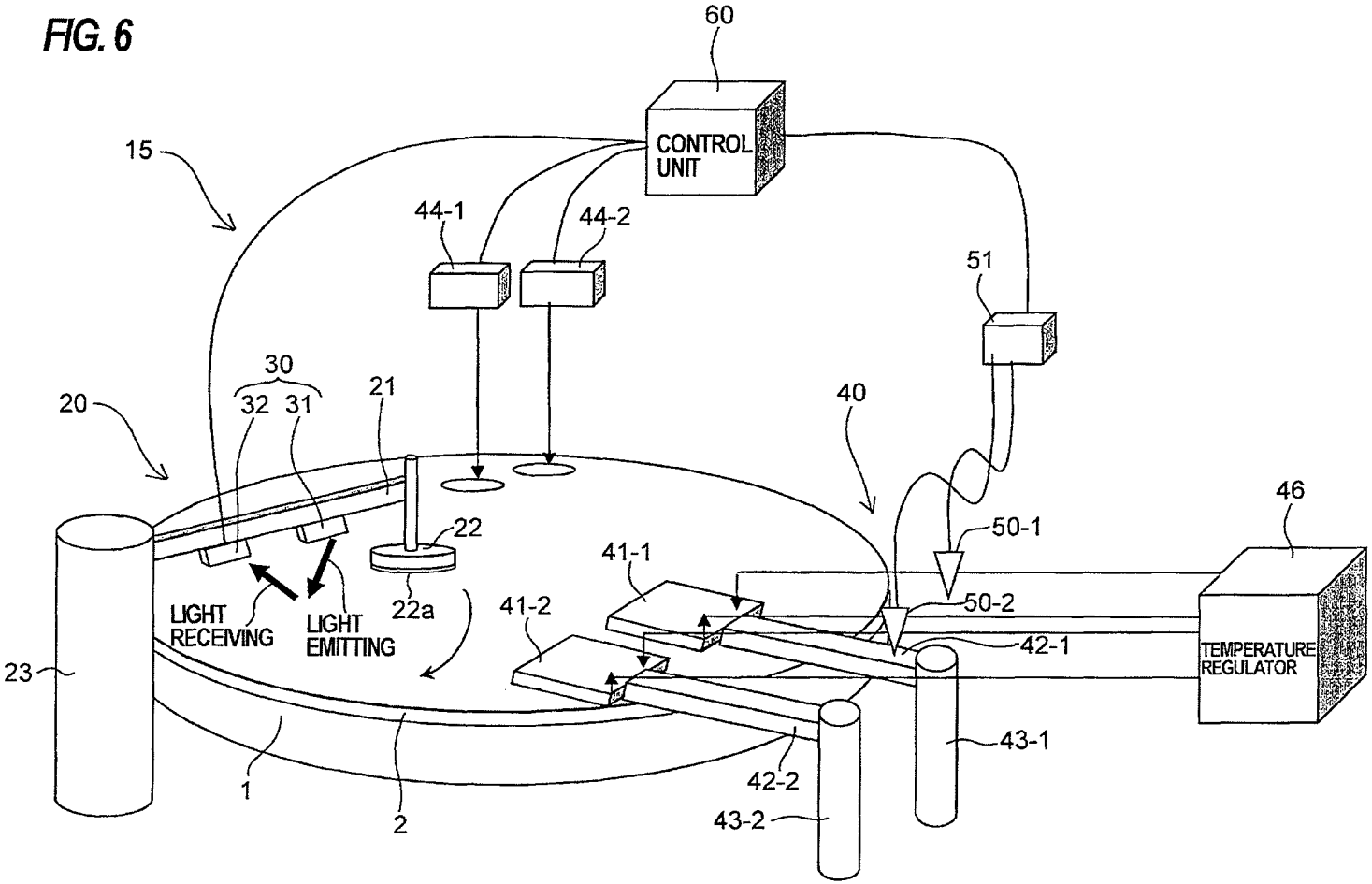
FIG. 6 is a schematic view showing a second embodiment of the conditioning apparatus.

FIG. 6 is a schematic view showing a second embodiment of the conditioning apparatus 15. As with the conditioning apparatus 15 according to the first embodiment, the conditioning apparatus 15 according to the second embodiment includes a dressing device 20, a measuring unit 30 for measuring the surface roughness of the polishing pad, a temperature adjustment unit 40 for adjusting the temperature of the polishing pad, and a control unit 60. However, in the second embodiment, the temperature adjustment unit 40 for adjusting the temperature of the polishing pad includes two pad contact members 41-1, 41-2, and two thermographs or radiation thermometers 44-1, 44-2. The pad contact member 41-1 is supported by a support shaft 43-1 via a support arm 42-1. The pad contact member 41-2 is supported by a support shaft 43-2 via a support arm 42-2.

A single liquid supply tank 46 for supplying a liquid to the pad contact member 41-1 and the pad contact member 41-2 is provided, and a temperature-controlled liquid is supplied individually to each of the pad contact members 41-1, 41-2 from the liquid supply tank 46 via flow rate regulating valves 50-1, 50-2. Further, temperature-controlled cooling water is supplied individually to each of the pad contact members 41-1, 41-2 from a cooling water line (not shown). Illustration of the valves is omitted in FIG. 6. Other structure of the second embodiment is the same as that of the first embodiment.

According to the conditioning apparatus 15 configured as shown in FIG. 6, the temperature of the polishing pad 2 can be adjusted at each of the radially different areas of the polishing pad 2 by the two pad contact members 41-1, 41-2 during dressing, and thus the surface roughness can be varied in a radial direction of the polishing pad 2. In this manner, by forming areas having different surface roughnesses in the radial direction of the polishing pad 2, the polishing profile of the substrate can be adjusted.

Figure 7:
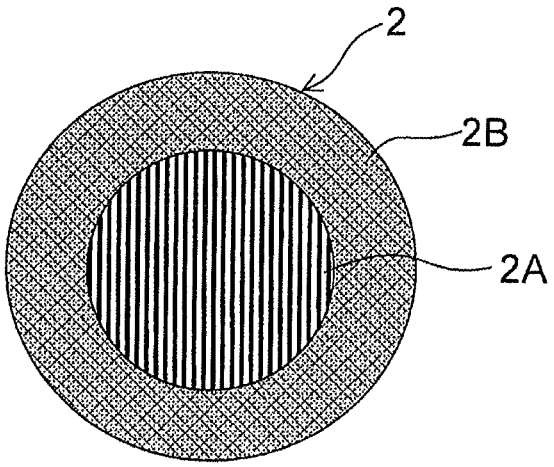
FIG. 7 is a plan view showing the status in which a radially inner area and a radially outer area of the polishing pad have different surface roughnesses.

FIG. 7 is a view showing the polishing pad which has been conditioned by the conditioning apparatus 15 shown in FIG. 6, and a plan view showing the status in which a radially inner area and a radially outer area of the polishing pad have different surface roughnesses. As shown in FIG. 7, the surface roughness of the radially inner area 2A of the polishing pad 2 is rough, and the surface roughness of the radially outer area 2B of the polishing pad 2 is fine.

Figure 8:
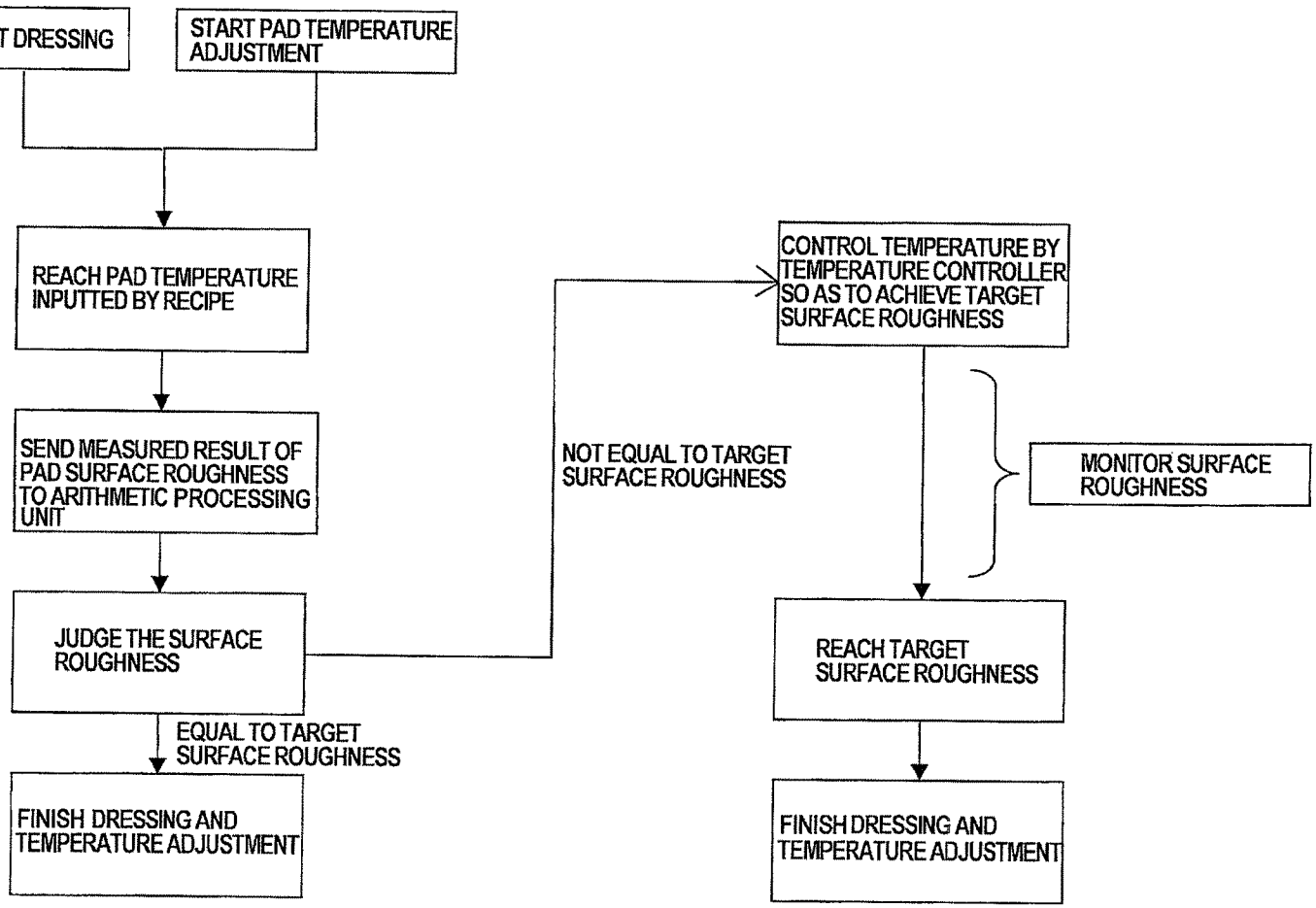
FIG. 8 is a flowchart showing a procedure of a conditioning method of the polishing pad according to an embodiment.

FIG. 8 is a flowchart showing a procedure of the conditioning method of the polishing pad according to an embodiment. As shown in FIG. 8, dressing of the polishing pad 2 is started by the dressing device 20 and adjustment of the surface temperature of the polishing pad 2 by the temperature adjustment unit 40 is started. First, adjustment of the surface temperature of the polishing pad 2 by the temperature adjustment unit 40 may be started, and then dressing by the dresser 22 may be started when the surface temperature of the polishing pad 2 reaches a predetermined temperature. When the surface temperature of the polishing pad 2 reaches a temperature which has been inputted by a recipe, the measured result of the surface roughness of the polishing pad 2 measured by the measuring unit 30 is sent to the control unit 60. When the measuring unit 30 measures the surface roughness of the polishing pad 2, the dresser 22 is pressed against the polishing pad 2 and the polishing table 1 is rotated, or the dresser 22 is spaced from the polishing pad 2 and the rotation of the polishing table 1 is stopped.

Next, the control unit 60 compares the measured surface roughness and the preset target surface roughness to judge the surface roughness. When the measured surface roughness is equal to the target surface roughness, dressing of the polishing pad 2 is finished and adjustment of the surface temperature of the polishing pad 2 is finished. When the measured surface roughness is not equal to the target surface roughness, the surface temperature of the polishing pad 2 is controlled, while performing dressing, by the temperature controller 51 so that the measured surface roughness becomes the target surface roughness. In this manner, the surface roughness monitoring in which the surface temperature of the polishing pad 2 is controlled so as to make the measured surface roughness equal to the target surface roughness while performing dressing is performed continuously, and when the measured surface roughness reaches the target surface roughness, dressing of the polishing pad 2 is finished and adjustment of the surface temperature of the polishing pad 2 is finished.

Although certain preferred embodiments of the present invention have been shown and described in detail, it should be understood that various changes and modifications may be made without departing from the scope of the appended claims.

What is claimed is:

1. A conditioning method for adjusting surface roughness of a polishing pad by dressing the polishing pad on a polishing table configured to polish a substrate with a dresser pressed against the polishing pad, comprising:

measuring surface roughness of the polishing pad during dressing of the polishing pad, the surface roughness being represented by at least one of five indexes comprising arithmetical mean deviation of the roughness profile (Ra), root mean square deviation of the roughness profile (Rq), maximum profile valley depth of the roughness profile (Rv), maximum profile peak height of the roughness profile (Rp), and maximum height of the roughness profile (Rz);

comparing the measured surface roughness with preset target surface roughness to obtain comparison result; and adjusting a surface temperature of the polishing pad by heating or cooling the polishing pad based on the comparison result.

2. The conditioning method according to claim 1, wherein the dressing of the polishing pad is performed while adjusting the surface temperature of the polishing pad to a predetermined temperature until the measured surface roughness reaches the target surface roughness.

3. The conditioning method according to claim 2, wherein the predetermined temperature is a surface temperature of the polishing pad corresponding to desired polishing performance based on relationship between surface roughness of the polishing pad and surface temperature of the polishing pad, and relationship between surface roughness of the polishing pad and polishing performance.

4. The conditioning method according to claim 2, wherein the dressing is finished when the surface roughness of the polishing pad reaches the target surface roughness.

5. The conditioning method according to claim 1, wherein the dressing is started when the surface temperature of the polishing pad reaches a predetermined temperature.

6. The conditioning method according to claim 1, wherein when the surface roughness of the polishing pad is measured, the dresser is pressed against the polishing pad and oscillated and the polishing table is rotated, or the dresser is spaced from the polishing pad and rotation of the polishing table is stopped.

7. The conditioning method according to claim 1, wherein the adjustment of the surface temperature of the polishing pad is performed by bringing a pad contact member, into which a temperature-adjusted fluid is supplied, into contact with the polishing pad, or by supplying a temperature-adjusted fluid to the polishing pad.

8. A conditioning apparatus for adjusting surface roughness of a polishing pad by dressing the polishing pad on a polishing table configured to polish a substrate, comprising:

a dressing device comprising a dresser configured to dress the polishing pad by being pressed against the polishing pad, and a mechanism configured to rotate the dresser and move the dresser along a surface of the polishing pad;

a surface roughness measuring device of the polishing pad configured to measure surface roughness of the polishing pad;

a temperature adjustment device of the polishing pad configured to adjust a surface temperature of the polishing pad; and a control unit configured to control the dressing device, the surface roughness measuring device, and the temperature adjustment device;

wherein the surface roughness of the polishing pad represented by at least one of five indexes comprising arithmetical mean deviation of the roughness profile (Ra), root mean square deviation of the roughness profile (Rq), maximum profile valley depth of the roughness profile (Rv), maximum profile peak height of the roughness profile (Rp), and maximum height of the roughness profile (Rz) is measured by the surface roughness measuring device of the polishing pad during dressing of the polishing pad.

9. The conditioning apparatus according to claim 8, wherein the control unit adjusts the surface temperature of the polishing pad by comparing the surface roughness measured by the surface roughness measuring device with preset target surface roughness to obtain comparison result, and by controlling the temperature adjustment device of the polishing pad based on the comparison result.

10. The conditioning apparatus according to claim 8, wherein relationship between surface roughness of the polishing pad and surface temperature of the polishing pad, and relationship between surface roughness of the polishing pad and polishing performance are stored in the control unit.

11. The conditioning apparatus according to claim 8, wherein the temperature adjustment device of the polishing pad comprises a pad contact member, into which a temperature-adjusted fluid is supplied, whose lower surface is brought into contact with the polishing pad, or comprises a nozzle configured to supply a temperature-adjusted fluid to the polishing pad.

12. The conditioning apparatus according to claim 11, wherein two or more of the pad contact members or the nozzles are provided in a radial direction of the polishing pad; and the two or more of the pad contact members or the nozzles are capable of adjusting the surface temperature of the polishing pad independently.

13. The conditioning apparatus according to claim 8, wherein the surface roughness measuring device of the polishing pad is arranged at a position where the surface roughness is measured at a downstream side of the dresser with respect to a rotational direction of the polishing table.

14. A polishing apparatus comprising:

a polishing table to which a polishing pad is attached; and a conditioning apparatus of the polishing pad according to claim 8.

15. A conditioning method for adjusting surface roughness of a polishing pad, comprising:

pressing a dresser against the polishing pad to conduct dressing of the polishing pad;

measuring surface roughness of the polishing pad;

comparing the measured surface roughness with preset target surface roughness to obtain a comparison result; and adjusting a surface temperature of the polishing pad to a predetermined temperature based on the comparison result during dressing of the polishing pad.

* * * * *